US006300909B1

(12) United States Patent
Tsubaki et al.

(10) Patent No.: US 6,300,909 B1
(45) Date of Patent: Oct. 9, 2001

(54) ANTENNA UNIT AND COMMUNICATION DEVICE USING THE SAME

(75) Inventors: Nobuhito Tsubaki, Shiga-Ken; Kazunari Kawahata, Machida, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/717,917

(22) Filed: Nov. 21, 2000

(30) Foreign Application Priority Data

Dec. 14, 1999 (JP) ..... 11-355086

(51) Int. Cl.[7] ..... H01Q 1/38
(52) U.S. Cl. ..... 343/700 MS; 343/702
(58) Field of Search ..... 343/700 MS, 702, 343/787, 829, 846, 848; H01Q 1/24, 1/38

(56) References Cited

U.S. PATENT DOCUMENTS

| | | | | |
|---|---|---|---|---|
| 5,861,854 | * | 1/1999 | Kawahata et al. | 343/702 |
| 5,867,126 | * | 2/1999 | Kawahata et al. | 343/702 |
| 5,903,240 | * | 5/1999 | Kawahata et al. | 343/700 MS |
| 6,100,849 | * | 8/2000 | Tsubaki et al. | 343/702 |
| 6,140,968 | * | 10/2000 | Kawahata et al. | 343/700 MS |
| 6,177,908 | * | 1/2001 | Kawahata et al. | 343/700 MS |

FOREIGN PATENT DOCUMENTS 11136025 5/1999 (JP) .

* cited by examiner

*Primary Examiner*—Tho G Phan
(74) *Attorney, Agent, or Firm*—Ostrolenk, Faber, Gerb & Soffen, LLP

(57) ABSTRACT

In an antenna unit, the generation of capacitances between each of the open ends of first and second microstrip antennas and a control electrode is controlled by turning a switch on and off, both antenna frequencies being simultaneously changed. The antenna unit has a basic body having first and second main surfaces and at least one end surface extending between the main surfaces; a grounding electrode provided on the first main surface of the basic body; a first radiation electrode forming a first antenna, having an open end at one end thereof, and provided on the second main surface of the basic body; a second radiation electrode forming a second antenna, having an open end at one end thereof, and provided on the second main surface of the basic body; a first connecting electrode for connecting the first radiation electrode to the grounding electrode, and provided on an end surface of the basic body; a second connecting electrode for connecting the second radiation electrode to the grounding electrode, and provided on an end surface of the basic body; a feeding electrode for transmitting a signal to at least one of the first radiation electrode and the second radiation electrode, and provided on the basic body; and a control electrode on the basic body for providing coupling capacitances between the open end of the first radiation electrode and the control electrode and between the open end of the second radiation electrode and the control electrode, and provided so as to be close to each of the open ends.

24 Claims, 4 Drawing Sheets

ANTENNA UNIT AND COMMUNICATION DEVICE USING THE SAME

BACKGROUND OF THE INVENTION

1. Field of the Invention

The present invention relates to an antenna unit in which double resonance is realized by using two antennas and in which it is possible to simultaneously change both frequencies. The present invention also relates to a communication device using the antenna unit.

2. Description of the Related Art

Among conventional antenna units, the antenna unit which has been disclosed in Japanese Unexamined Patent Application Publication No. 11-136025 (Japanese Patent Application No. 10-204902) is taken as an example and described with reference to FIG. 8.

In the drawing, an antenna unit 101 is shown. The unit 101 includes a switch 109 is coupled to an antenna 100. The antenna 100 comprises a grounding electrode 103, a radiation electrode 104, a feeding electrode 106, and a control electrode 108 provided on the surface of a basic body 102 made of a dielectric material. One end of the radiation electrode 104 is open circuited. Furthermore, the feeding electrode 106 is formed so as to be close to the open end of the radiation electrode 104 and is connected to a signal source 110. Furthermore, one end of the switch 109 is connected to the control electrode 108 and the other end is grounded.

In the antenna unit 101 thus constructed, the radiation electrode 104 resonates as a microstrip antenna having a line length of $\lambda/4$ where $\lambda$ is the wavelength and functions as an antenna when part of the resonance power is radiated into space.

It is possible to change frequencies using the switch 109. That is, when the switch 109 is on, capacitance generated between the open end of the radiation electrode 104 and the control electrode 108 is connected so as to be in parallel with capacitance between the open end of the radiation electrode 104 and the grounding electrode 103. On the other hand, when the switch is off, capacitance is not generated between the open end of the radiation electrode 104 and the control electrode 108. Therefore, when the switch 109 is on, the frequency becomes relatively low, and when the switch is off, the frequency becomes relatively high.

However, in the conventional antenna unit 101, frequencies of the single antenna unit 100 are to be switched over and it is difficult to realize broader bandwidth.

SUMMARY OF THE INVENTION

Accordingly, it is an object of the present invention to provide an antenna unit in which it is possible to realize broader bandwidth by establishing double resonance using two antennas and by switching over each frequency into another, and to provide a communication device using the antenna unit.

In order to attain the above-mentioned objects, an antenna unit according to the present invention comprises a basic body; a grounding electrode provided on one main surface of the basic body; a first radiation electrode, having an open end at one end thereof, comprising a first antenna and provided on the other main surface of the basic body; a second radiation electrode, having an open end at one end thereof, comprising a second antenna and provided on the other main surface of the basic body; a first connecting electrode provided on an end surface of the basic body for connecting the first radiation electrode to the grounding electrode; a second connecting electrode provided on the end surface of the basic body for connecting the second radiation electrode to the grounding electrode; a feeding electrode provided on the basic body for transmitting a signal to at least one of the first radiation electrode and the second radiation electrode; and a control electrode provided so as to be close to each of the open ends of the basic body for providing coupling between the open end of the first radiation electrode and the control electrode and between the open end of the second radiation electrode and the control electrode.

Furthermore, in an antenna unit according to the present invention, the first antenna and the second antenna have different resonance frequencies from each other.

Furthermore, in an antenna unit according to the present invention, the control electrode is formed on a surface different from the surface where the first connecting electrode and the second connecting electrode are formed.

Furthermore, in an antenna unit according to the present invention, the basic body is made of a dielectric material or a magnetic material of a nearly rectangular solid.

Furthermore, in an antenna unit according to the present invention, a slit which is oblique to each side of the other main surface of the basic body is formed on the other main surface of the basic body, and the first radiation electrode and the second radiation electrode are disposed so as to face each other across the slit.

Furthermore, in an antenna unit according to the present invention, the slit is formed so that the width at the side of one end is narrower than the width at the side of the other end.

Furthermore, in an antenna unit according to the present invention, the feeding electrode is disposed on an end surface of the basic body so as to be close to the first radiation electrode or the second radiation electrode via a gap.

Furthermore, in an antenna unit according to the present invention, the feeding electrode is integrally formed on the end surface of the basic body where the first connecting electrode or the second connecting electrode is provided, so as to be continuous with the first connecting electrode or the second connecting electrode.

Furthermore, in an antenna unit according to the present invention, the first radiation electrode and the second radiation electrode are disposed on the other main surface of the basic body so that the first radiation electrode and the second radiation electrode sandwich the feeding electrode, and the first radiation electrode, the second radiation electrode, and the feeding electrode are disposed so that their longitudinal directions are parallel to each other.

Furthermore, a communication device according to the present invention comprises an antenna unit having the above-mentioned construction.

In an antenna unit according to the present invention, double resonance is realized by using two antennas, and, by turning on and off a switch connected to a control electrode, coupling capacitances to determine the degree of frequency change of both resonance frequencies are increased or decreased and thus the frequencies can be changed. Therefore, it is possible to realize a much broader bandwidth when compared with the case where the frequencies of a single antenna are changed.

Furthermore, by providing a plurality of control electrodes and switches respectively connected thereto, and by turning on and off each of the switches, it is possible to establish a much broader bandwidth.

Furthermore, in a communication device according to the present invention, because an antenna unit where frequencies can be changed is provided, it is possible to establish a broader bandwidth.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

Figure 1:
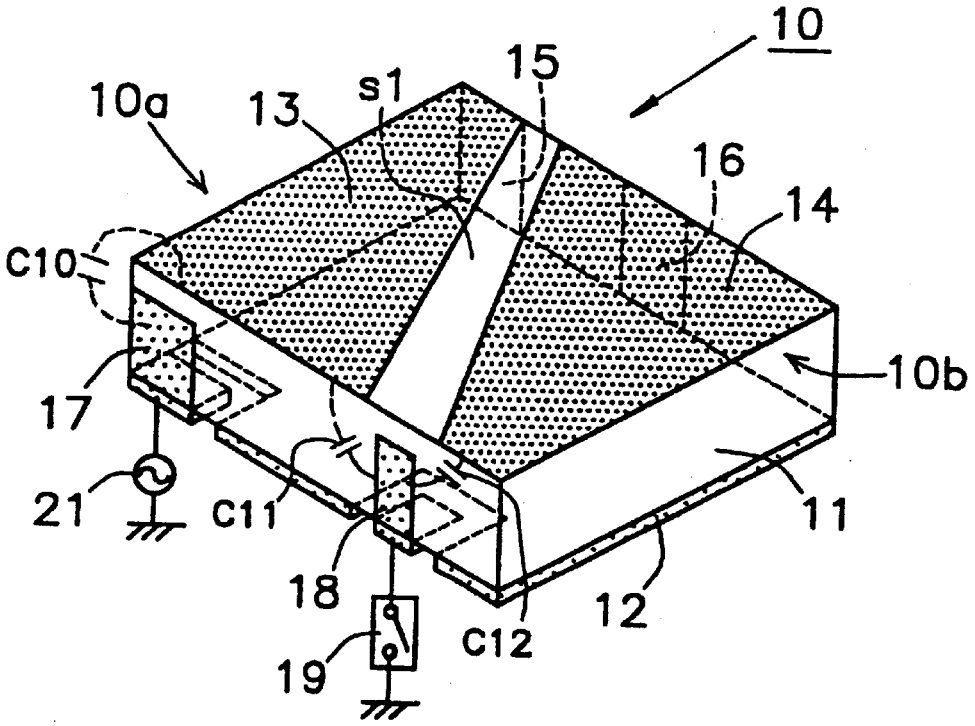
FIG. 1 is a perspective view showing an antenna unit according to a first embodiment of the present invention.

The construction of an antenna unit according to a first embodiment of the present invention will be described with reference to FIG. 1.

In the drawing, an antenna unit 10 is made up of a basic body 11 of a dielectric material such as ceramic, resin, etc., which comprises a grounding electrode 12, a first microstrip antenna 10*a* as a first antenna, and a second microstrip antenna 10*b* as a second antenna.

Out of these, the grounding electrode 12, is formed on one main surface of the basic body 11. Furthermore, the first microstrip antenna 10*a* comprises a first radiation electrode 13 formed on the other main surface of the basic body 11. Furthermore, the second microstrip antenna 10*b* comprises a second radiation electrode 14 formed on the other main surface of the basic body 11.

The first and second radiation electrodes 13 and 14 are formed so as to face each other through a slit s1. This slit s1 is formed so that the width on the side of one end may be narrower than the width on the side of the other end and that the slit may be oblique to each side of the other main surface, and accordingly the first radiation electrode 13 and the second radiation electrode 14 are of a trapezoidal form having a long side, short side, perpendicular side, and inclined side, respectively.

Furthermore, the first radiation electrode 13 is connected to the grounding electrode 12 through a first connecting electrode 15 formed on an end surface of the basic body 11. Furthermore, the second radiation electrode 14 is connected to the grounding electrode 12 through a second connecting electrode 16 formed on the end surface of the basic body 11. On an end surface opposite to the end surface of the basic body 11 on which the first and second connecting electrode 15 and 16 are provided, a feeding electrode 17 is formed so as to be close to the first radiation electrode 13 through a fixed gap. One end of this feeding electrode 17 extends to one main surface of the basic body 11 and is connected to a signal source 21 while it is insulated from the grounding electrode 12.

Furthermore, on the end surface of the basic body 11 where the feeding electrode 17 is formed, one end of a control electrode 18 is formed so as to be close to each open end of the first and second radiation electrodes 13 and 14. The other end of the control electrode 18 is connected to one end of a switch 19. The other end of the switch 19 is grounded.

The operation of the antenna unit 10 constructed in this way is described.

A signal input to the feeding electrode 17 from the signal source 21 is transmitted to the first radiation electrode 13 through capacitance C10 generated between the feeding electrode 17 and the first radiation electrode 13. In the first radiation electrode 13, the long side of the trapezoidal electrode is made open-ended and the short side is grounded through the first connecting electrode 15, and accordingly, resonance is established at a frequency having a wavelength one fourth of the effective wavelength, which is the distance between the long side and the short side. Here, the first connecting electrode 15 and the second connecting electrode 16 are electromagnetically coupled, and by this coupling the signal is transmitted to the second radiation electrode 14 from the first radiation electrode 13, and resonance is also established in the second radiation electrode 14 where the short side is openended.

Figure 2:
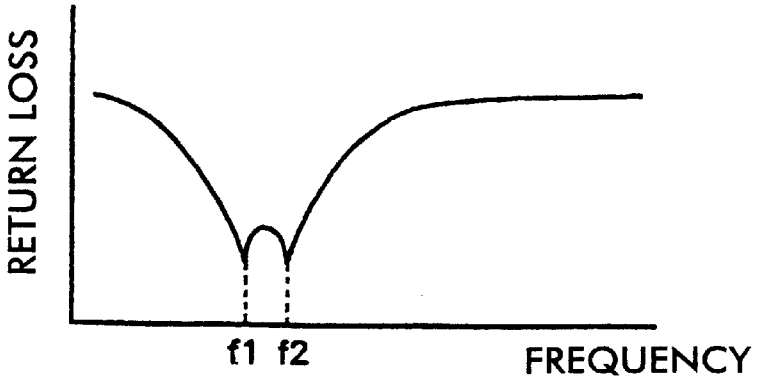
FIG. 2 shows an impedance characteristic of the antenna unit in FIG. 1.

The impedance characteristic of the antenna unit 10 is shown in FIG. 2. In the drawing, a frequency band including two resonance frequencies f1 and f2 is formed.

Furthermore, resonance frequencies of the first and second microstrip antennas 10*a* and 10*b* are decided by inductance produced by the first and second radiation electrodes 13 and 14 and coupling capacitances generated between electrodes, respectively. Capacitances C11 and C12 between each open end of the first and second radiation electrodes 13 and 14 and the control electrode 18 constitute part of the capacitance which determines the resonance frequencies of the microstrip antennas 10*a* and 10*b*. Each of the capacitances C11 and C12 is generated when the switch 19 is on, and either of them is not generated when the switch 19 is off. Therefore, when the switch 19 is turned on and off, both the resonance frequencies of the first and second microstrip antennas 10*a* and 10*b* are simultaneously changed, and accordingly, different frequency ranges can be covered. In this way, it becomes possible to cover a very broad band.

Figure 3:
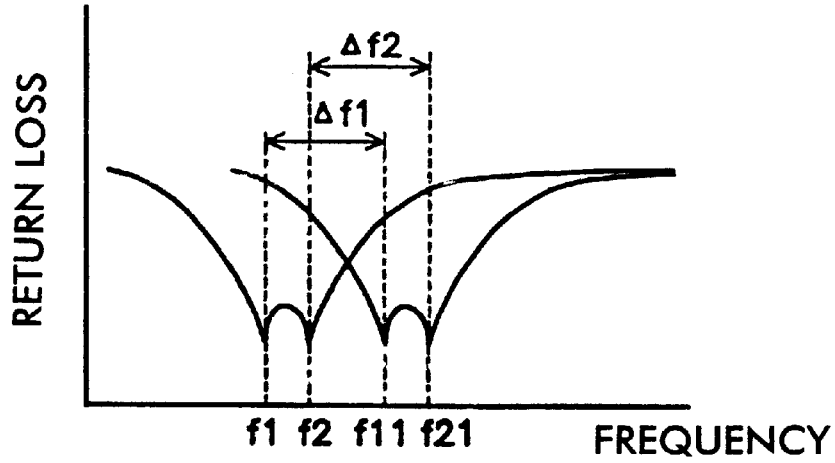
FIG. 3 shows the change of impedance characteristics of the antenna unit in FIG. 1 by turning a switch on and off.

Because of such frequency change, a frequency characteristic as shown in FIG. 3 can be obtained. In the drawing, when the switch is on, a frequency band including two frequencies f1 and f2 is formed, and when the switch is off, a frequency band including frequencies f11 and f12 to which f1 and f2 are shifted by frequency differences $\Delta$f1 and $\Delta$f2, respectively, is formed. Here, the frequency differences Df1 and Df2 can be easily controlled by adjusting the location where the control electrode 18 is provided and by changing the value of capacitances C11 and C12 between each open end of the first and second radiation electrodes 13 and 14 and the control electrode 18.

Moreover, although not particularly illustrated, a plurality of control electrodes and switches connected thereto may be formed. In this way, by turning on and off a plurality of switches, it is possible to control generation of capacitances between the open end of each radiation electrode and each control electrode and to realize a much broader band.

Figure 4:
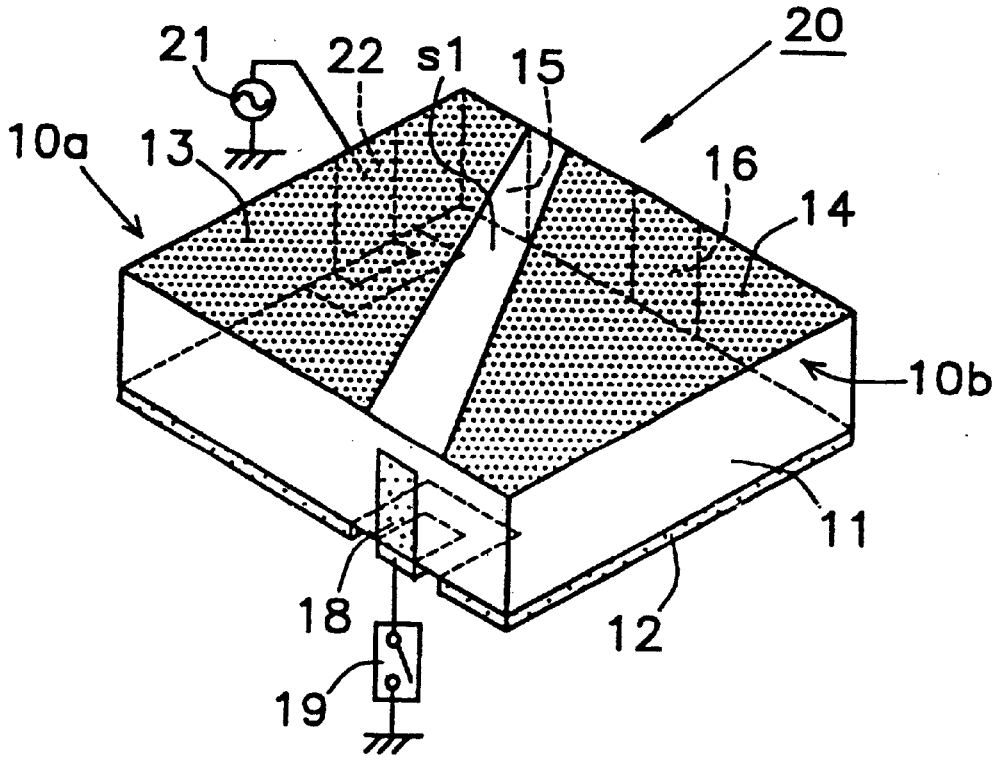
FIG. 4 is a perspective view showing a modified example of the antenna unit in FIG. 1.

In FIG. 4, a modified example of the above-mentioned antenna unit 10 is shown. In an antenna unit 20 in the drawing, a feeding electrode 22 is formed on an end surface neighboring an end surface where a first and second connecting electrode 15 and 16 are formed, of a basic body 11. Furthermore, one end of the feeding electrode 22 is integrally formed continuously with a first radiation electrode 13. The construction of the remainder is the same as that in the antenna unit 10.

The antenna unit 20 to be constructed in this way is different from the antenna unit 10 in that resonance is produced because of the first radiation electrode 13 directly fed by the feeding electrode 22, and the frequency can be changed in the same way as in the antenna 10.

Moreover, although not particularly illustrated, one end of the feeding electrode may be integrally formed so as to be continuous with a second radiation electrode.

Figure 5:
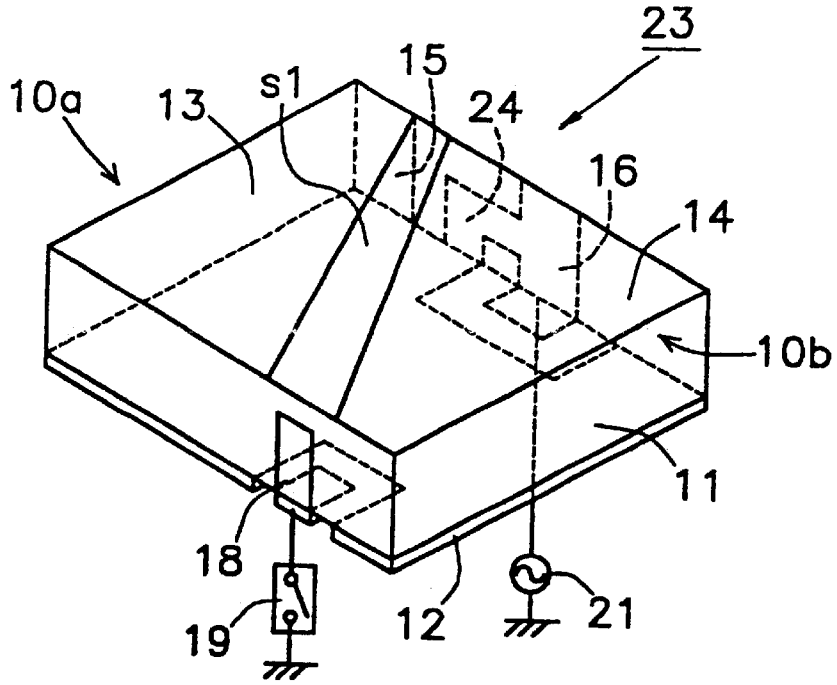
FIG. 5 is a perspective view showing another modified example of the antenna unit in FIG. 1.

In FIG. 5, another modified example of the above-mentioned antenna unit 10 is shown. In an antenna 23 in the drawing, a feeding electrode 24 is formed on an end surface where a second connecting electrode 16 is formed, of a basic body 11. Furthermore, one end of the feeding electrode 24 is integrally formed continuously with a second connecting electrode 16. The construction of the remainder is the same as that in the antenna unit 10.

The antenna unit 23 thus constructed is different from the antenna unit 10 in that resonance is produced because of a second radiation electrode 14 fed from the feeding electrode 24 through the second connecting electrode 16, and frequency can be changed in the same way as in the antenna 10.

Moreover, although not particularly illustrated, one end of the feeding electrode may be integrally formed so as to be continuous with a first connecting electrode.

Figure 6:
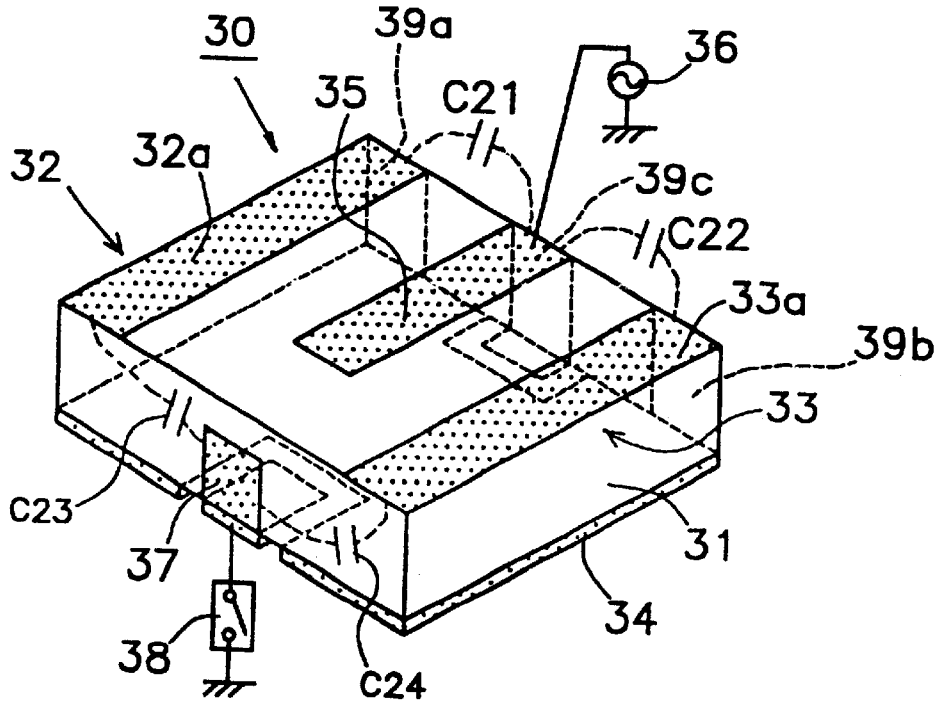
FIG. 6 is a perspective view showing an antenna unit according to a second embodiment of the present invention.

Next, the construction of an antenna unit according to a second embodiment of the present invention is described with reference to FIG. 6.

In the drawing, an antenna unit 30 comprises a first microstrip antenna 32 as a first antenna and a second microstrip antenna 33 as a second antenna which are formed on a basic body 31 of a rectangular solid made of dielectric material such as ceramic, resin, etc.

Here, on nearly all of one main surface of the basic body 31, a grounding electrode 34 is formed. Furthermore, a first radiation electrode 32*a* constituting the first microstrip antenna 32 and a second radiation electrode 33*a* constituting the second microstrip antenna 33 which are parallel to each other, are formed so as to be in contact with a pair of sides, opposed to each other, of the other main surface of the basic body 31, respectively. Furthermore, each one end of the first and second radiation electrode 32*a* and 33*a* is formed so as to be open circuited and each of the other ends is connected to the grounding electrode 34 through a first connecting electrode 39*a* and a second connecting electrode 39*b* formed on an end surface of the basic body 31, respectively.

Furthermore, in a location sandwiched between the first and second radiation electrode 32*a* and 33*a*, a feeding electrode 35 is formed so as to be parallel to the first and second radiation electrodes 32*a* and 33*a*. One end of the feeding electrode 35 is disposed nearly in the center of the other main surface of the basic body 31, and the other end is connected to a signal source 36 through a third connecting electrode 39*c* formed on the end surface of the basic body 31.

Moreover, on an end surface opposed to the end surface where the first to third connecting electrodes 39*a* through 39*c* of the basic body 31 are provided, a control electrode 37 is formed. The control electrode 37 is disposed so as to be close to each open end of the first and second radiation electrode 32*a* and 33*a*. Furthermore, the control electrode 37 is grounded through a switch 38.

In the antenna unit 30 thus constructed, when the switch 38 is turned on, the control electrode 37 is grounded, and capacitances C23 and C24 between the first and second radiation electrode 32*a* and 33*a* and the control electrode 37 increase and each frequency of the first and second microstrip antenna 32 and 33 decreases.

On the other hand, when the switch 38 is tuned off, the capacitances C23 and C24 greatly decrease because of the influence of stray capacitance, etc., and each frequency of the first and second microstrip antenna 32 and 33 increases.

Furthermore, although not particularly shown, by forming a plurality of control electrodes and switches connected thereto, respectively, and by turning these switches on and off, it is possible to realize a much broader band.

Figure 7:
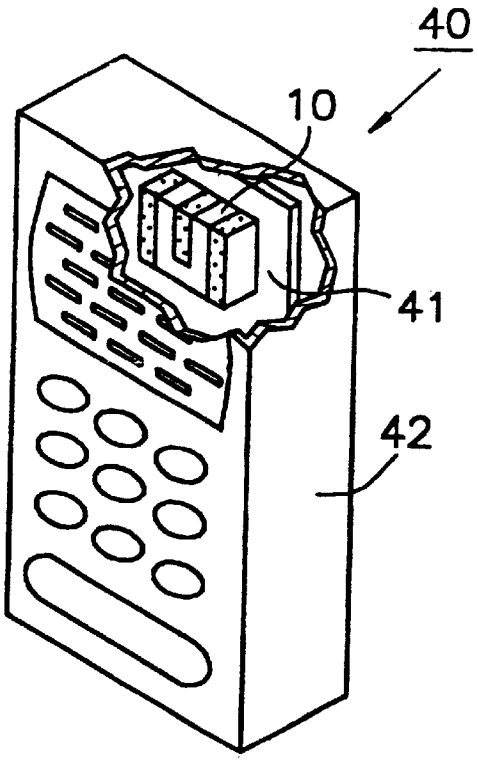
FIG. 7 is a perspective view showing a communication device (telephone) according to the present invention.
Figure 8:
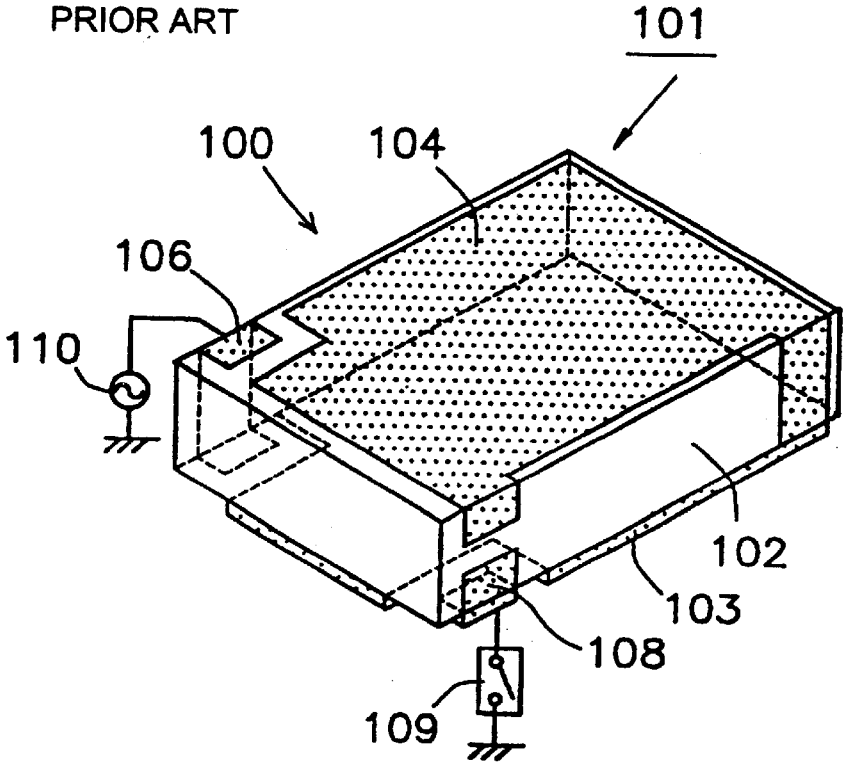
FIG. 8 PRIOR ART
FIG. 8 is a perspective view showing a conventional antenna unit.

Next, among communication devices according to the present invention, a portable telephone is taken as an example and described with reference to FIG. 7. In the drawing, on a portable telephone 40, an antenna unit 10 of the above-mentioned first embodiment and other circuit elements (not illustrated) are mounted, and a mother board 41 with a circuit pattern printed thereon is housed in a case 42. The circuit board includes a transmitter/receiver circuit. The antenna unit to be used in the portable telephone 40 may also be an antenna unit 20 or 30 of the above-mentioned other embodiments.

In this way, the portable telephone 40 can cover a broader band by mounting an antenna unit 10, 20, or 30, and, for example, as a dual-mode telephone to be able to deal with both an analog system and a digital system, a broader frequency band in each system can be handled.

Moreover, in each of the above-mentioned embodiments, a switch to be connected to the control electrode may be of any construction if the switch is able to control the electrical connection, and, for example, an element such as a diode, a transistor, a field-effect transistor (FET), etc., can be used.

Furthermore, in each of the above-mentioned embodiments, the cases where an antenna unit comprises a basic body made of dielectric material has been described, but a basic body made of magnetic material such as ferrite, etc., may be used.

Furthermore, in each of the above-mentioned embodiments, the cases where a control electrode is formed so as to extend from one main surface to an end surface of a basic body are described, but the control electrode may be formed so as to extend from one main surface to the other main surface through an end surface.

Furthermore, in each of the above-mentioned embodiments, the cases where a feeding electrode is formed so as to extend from one main surface to an end surface of a basic body are described, but the feeding electrode may be formed only on one main surface of the basic body. In this case, part of a radiation electrode is extended from the other main surface to an end surface of the basic body, and capacitance generated between the extended radiation electrode and the feeding electrode is used.

In an antenna unit according to the present invention, double resonance is realized by using two antennas, and by turning on and off a switch connected to a control electrode and by increasing or decreasing capacitances which determine both of two frequencies, the resonance frequency of each antenna can be changed. Therefore, when compared with cases where frequencies of a single antenna are changed, it is possible to realize greatly broader bandwidth.

Furthermore, in an antenna unit according to the present invention, by providing a plurality of control electrodes and switches connected thereto and by turning each of the switches on and off, it is possible to realize much broader bandwidth.

Furthermore, in a communication device according to the present invention, an antenna unit where frequencies can be changed is mounted and accordingly it is possible to realize broader bandwidth.

While the invention has been particularly shown and described with reference to preferred embodiments, it will be understood by those skilled in the art that the foregoing and other changes in form and details can be made without departing from the spirit and scope of the invention.

What is claimed is:

1. An antenna unit comprising:

a basic body having first and second main surfaces and at least one surface extending between the main surfaces;

a grounding electrode provided on the first main surface of the basic body;

a first radiation electrode comprising a first antenna, having an open end at one end thereof, and provided on the second main surface of the basic body;

a second radiation electrode comprising a second antenna, having an open end at one end thereof, and provided on the second main surface of the basic body;

a first connecting electrode for connecting the first radiation electrode to the grounding electrode, and provided on an end surface of the basic body;

a second connecting electrode for connecting the second radiation electrode to the grounding electrode, and provided on an end surface of the basic body;

a feeding electrode for transmitting a signal to at least one of the first radiation electrode and the second radiation electrode, and provided on the basic body; and a control electrode on the basic body for providing coupling capacitances between the open end of the first radiation electrode and the control electrode and between the open end of the second radiation electrode and the control electrode, and provided so as to be close to each of the open ends.

2. The antenna unit of claim 1, wherein the first antenna and the second antenna have different resonance frequencies from each other.

3. The antenna unit of claim 1, wherein the control electrode is formed on a surface different from the surface where the first connecting electrode and the second connecting electrode are formed.

4. The antenna unit of claim 2, wherein the control electrode is formed on a surface different from the surface where the first connecting electrode and the second connecting electrode are formed.

5. The antenna unit of claim 1, wherein the basic body is made of a dielectric material or a magnetic material of a nearly rectangular solid.

6. The antenna unit of claim 1, wherein a slit which is oblique to each side of the second main surface of the basic body is formed on the second main surface of the basic body, and wherein the first radiation electrode and the second radiation electrode are disposed so as to face each other through the slit.

7. The antenna unit of claim 6, wherein the slit is formed so that a width at a first end thereof is narrower than a width at a second end.

8. The antenna unit of claim 1, wherein the feeding electrode is disposed on an end surface of the basic body so as to be close to the first radiation electrode or the second radiation electrode through a gap.

9. The antenna unit of claim 1, wherein the feeding electrode is integrally formed on the end surface of the basic body where the first connecting electrode or the second connecting electrode is provided, so as to be continuous with the first connecting electrode or the second connecting electrode.

10. The antenna unit of claim 1, wherein the first radiation electrode and the second radiation electrode are disposed on the second main surface of the basic body so that the first radiation electrode and the second radiation electrode sandwich the feeding electrode, and wherein the first radiation electrode, the second radiation electrode and the feeding electrode are disposed so that longitudinal directions thereof are parallel to each other.

11. The antenna unit of claim 1, wherein one end of the control electrode is for providing the coupling capacitances and the other end of the control electrode is connected to a switch.

12. The antenna unit of claim 11, wherein the switch changes each coupling capacitance simultaneously.

13. A communication device comprising:

at least one of a transmitter and a receiver; and an antenna unit coupled to the at least one of a transmitter and a receiver, the antenna unit comprising:

a basic body having first and second main surfaces and at least one end surface extending between the main surfaces;

a grounding electrode provided on the first main surface of the basic body;

a first radiation electrode comprising a first antenna, having an open end at one end thereof, and provided on the second main surface of the basic body;

a second radiation electrode comprising a second antenna, having an open end at one end thereof, and provided on the second main surface of the basic body;

a first connecting electrode for connecting the first radiation electrode to the grounding electrode, and provided on an end surface of the basic body;

a second connecting electrode for connecting the second radiation electrode to the grounding electrode, and provided on an end surface of the basic body;

a feeding electrode for transmitting a signal to at least one of the first radiation electrode and the second radiation electrode, and provided on the basic body; and a control electrode on the basic body for providing coupling capacitances between the open end of the first radiation electrode and the control electrode and between the open end of the second radiation electrode and the control electrode, and provided so as to be close to each of the open ends.

14. The communication device of claim 13, wherein the first antenna and the second antenna have different resonance frequencies from each other.

15. The communication device of claim 13, wherein the control electrode is formed on a surface different from the surface where the first connecting electrode and the second connecting electrode are formed.

16. The communication device of claim 14, wherein the control electrode is formed on a surface different from the surface where the first connecting electrode and the second connecting electrode are formed.

17. The communication device of claim 13, wherein the basic body is made of a dielectric material or a magnetic material of a nearly rectangular solid.

18. The communication device of claim 13, wherein a slit which is oblique to each side of the second main surface of the basic body is formed on the second main surface of the basic body, and wherein the first radiation electrode and the second radiation electrode are disposed so as to face each other through the slit.

19. The communication device of claim 18, wherein the slit is formed so that a width at a first end thereof is narrower than a width at a second end.

20. The communication device of claim 13, wherein the feeding electrode is disposed on an end surface of the basic body so as to be close to the first radiation electrode or the second radiation electrode through a gap.

21. The communication device of claim 13, wherein the feeding electrode is integrally formed on the end surface of the basic body where the first connecting electrode or the second connecting electrode is provided, so as to be continuous with the first connecting electrode or the second connecting electrode.

22. The communication device of claim 13, wherein the first radiation electrode and the second radiation electrode are disposed on the second main surface of the basic body so that the first radiation electrode and the second radiation electrode sandwich the feeding electrode, and wherein the first radiation electrode, the second radiation electrode and the feeding electrode are disposed so that longitudinal directions thereof are parallel to each other.

23. The communication device unit of claim 13, wherein one end of the control electrode is for providing the coupling capacitances, and the other end of the control electrode is connected to a switch.

24. The communication device of claim 23, wherein the switch changes each coupling capacitance simultaneously.

* * * * *